US012241699B2

(12) United States Patent
Hamada et al.

(10) Patent No.: US 12,241,699 B2
(45) Date of Patent: Mar. 4, 2025

(54) HEAT EXCHANGER

(71) Applicant: DENSO CORPORATION, Kariya (JP)

(72) Inventors: Hiroshi Hamada, Kariya (JP); Tomohiko Nakamura, Kariya (JP); Ichio Kamei, Kariya (JP); Shota Chatani, Kariya (JP)

(73) Assignee: DENSO CORPORATION, Kariya (JP)

( * ) Notice: Subject to any disclaimer, the term of this patent is extended or adjusted under 35 U.S.C. 154(b) by 224 days.

(21) Appl. No.: 17/857,677

(22) Filed: Jul. 5, 2022

(65) Prior Publication Data

US 2022/0333875 A1 Oct. 20, 2022

Related U.S. Application Data

(63) Continuation of application No. PCT/JP2021/001021, filed on Jan. 14, 2021.

(30) Foreign Application Priority Data

Jan. 28, 2020 (JP) ..... 2020-011615

(51) Int. Cl.
*F28F 9/02* (2006.01)
*F28F 9/22* (2006.01)

(52) U.S. Cl.
CPC ..... *F28F 9/028* (2013.01); *F28F 9/22* (2013.01)

(58) Field of Classification Search
CPC ..... F28F 9/028; F28F 9/22
USPC ..... 165/101
See application file for complete search history.

(56) References Cited

U.S. PATENT DOCUMENTS 7,841,393 B2 * 11/2010 Sekito ..... F28D 1/05366 165/174
9,032,939 B2 * 5/2015 Glugla ..... F02D 23/00 123/542
2008/0029254 A1 * 2/2008 Sekito ..... F28F 9/026 165/148
2020/0263930 A1 * 8/2020 Greber ..... F28D 21/0003
2022/0333875 A1 * 10/2022 Hamada ..... F28F 9/22
2022/0349655 A1 * 11/2022 Chatani ..... F28F 9/0265

FOREIGN PATENT DOCUMENTS

JP 4830918 B2 12/2011
WO WO-2020012921 A1 1/2020

* cited by examiner

*Primary Examiner* — Raheena R Malik
(74) *Attorney, Agent, or Firm* — Harness, Dickey & Pierce, P.L.C.

(57) ABSTRACT

A heat exchanger includes tubes, a tank, and a prevention plate arranged inside the tank and contacting end surfaces of the tubes to prevent heat medium from flowing into the tubes in a certain region. Flow paths are formed in each tube and arranged in a width direction of the tube. The prevention plate includes a deformable portion elastically deformable by contacting an edge of the opening at a time of inserting the prevention plate into the tank from the opening. The deformable portion of the prevention plate that has been inserted into the tank is restored and receives a reaction force from an inner surface of the tank such that the prevention plate is shifted along the width direction by the reaction force.

5 Claims, 12 Drawing Sheets

HEAT EXCHANGER

CROSS REFERENCE TO RELATED APPLICATIONS

The present application is a continuation application of International Patent Application No. PCT/JP2021/001021 filed on Jan. 14, 2021, which designated the U.S. and claims the benefit of priority from Japanese Patent Application No. 2020-011615 filed on Jan. 28, 2020. The entire disclosure of the above application is incorporated herein by reference.

TECHNICAL FIELD

The present disclosure relates to a heat exchanger that performs heat exchange between air and heat medium.

BACKGROUND

A heat exchanger performs heat exchange between air and heat medium and includes a pair of tanks connected via tubes.

SUMMARY

A heat exchanger according to at least one embodiment of the present disclosure performs heat exchange between air and heat medium. The heat exchanger includes tubes, a tank and a prevention plate. The tubes are arranged in a stacking direction and being tubular members having flow paths through which the heat medium passes. The tank is a container that supplies the heat medium to each of the tubes. An end portion of the tank in the stacking direction has an opening as an inlet for the heat medium. The prevention plate has a plate shape and is arranged inside the tank. The prevention plate contacts end surfaces of the tubes within a certain region to prevent the heat medium from flowing into the tubes in the certain region. A width direction is defined as a direction perpendicular to the stacking direction and parallel to a direction of air flowing between the tubes. More than one of the flow paths are formed in each of the tubes and arranged in the width direction. The prevention plate has a deformable portion. The deformable portion is elastically deformable by contacting an edge of the opening of the tank at a time of inserting the prevention plate into the tank through the opening. The deformable portion of the prevention plate that has been inserted into the tank is restored and receives a reaction force from an inner surface of the tank such that the prevention plate is shifted along the width direction by the reaction force.

BRIEF DESCRIPTION OF DRAWINGS

The details of one or more embodiments are set forth in the accompanying drawings and the description below. Other features and advantages will be apparent from the description and drawings, and from the claims.

DETAILED DESCRIPTION

Figure 1:
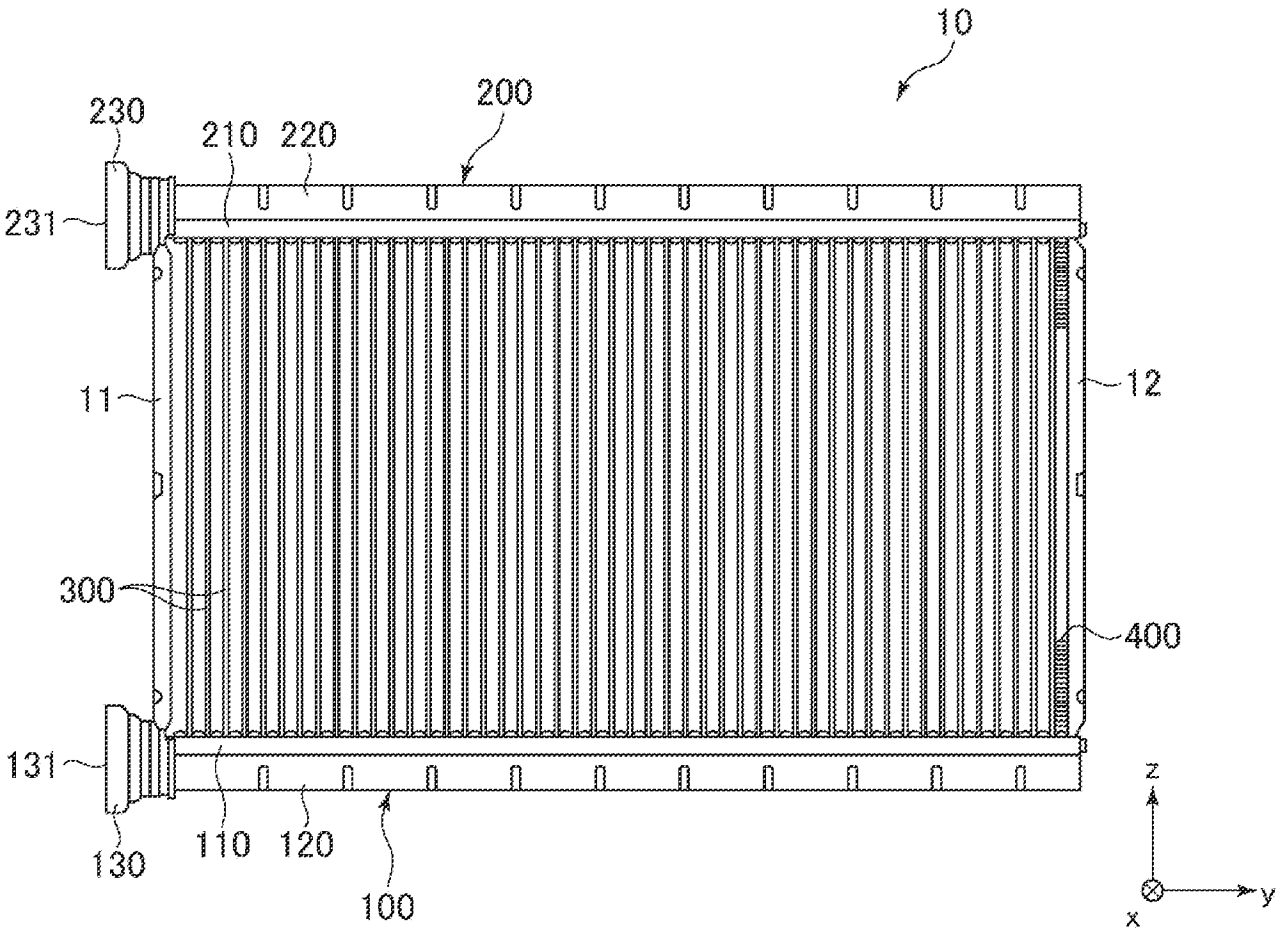
FIG. 1 is a diagram illustrating an overall configuration of a heat exchanger according to a first embodiment.

To begin with, examples of relevant techniques will be described.

According to a comparative example, a heat exchanger that performs heat exchange between air and heat medium is, for example, a radiator provided in a vehicle or a heater core provided in an air conditioner. Such a heat exchanger has a configuration in which a pair of tanks are connected via tubes. Heat exchange is performed at each tube between the heat medium passing through an inner flow path of the tube and the air passing through a space outside the tube.

In the heat exchanger having such a configuration, it may be better for the heat medium to equally flow into the tubes from an inlet tank so that heat exchange is uniformly performed as a whole. However, an inflow amount of the heat medium is likely to be larger in tubes arranged in the vicinity of an inlet port of the inlet tank, which receives the heat medium from an outside, than in tubes arranged far from the inlet port.

Therefore, in the heat exchanger of the comparative example, an end portion of each tube is partially closed by a plate-shaped member, thereby reducing inequality in flow rate of the heat medium flowing into the tubes.

In the heat exchanger of the comparative example, a center of an end surface of each tube in a width direction, that is, a center of the end surface in a flow direction of air is closed by a plate-shaped member. According to experiments conducted by the present inventors, it has been found that in such a configuration, the effect of reducing the inequality due to arrangement of the plate-shaped member is not sufficient, and the heat medium still flows into the tubes arranged in the vicinity of the inlet port at a large flow rate.

The present inventors have studied that a region of the end surface of the tube closed by the plate-shaped member is set at a position shifted from the center in the width direction, not at the center in the width direction. It has been confirmed by experiments and the like that when the plate-shaped member is arranged at the position shifted from the center, inequality in flow rate of the heat medium flowing into the tubes can be sufficiently reduced.

In view of workability in manufacturing the heat exchanger, the plate-shaped member may be inserted and attached through an opening formed at one end of the tank, i.e. an opening formed as an inlet for the heat medium, after completion of brazing the tank, the tube, and the like. However, in a method of inserting the plate-shaped member from the opening of the tank, the plate-shaped member can be arranged at the center in the width direction, but it is difficult to arrange the plate-shaped member at the position shifted from the center in the width direction.

In contrast, according to the present disclosure, a heat exchanger can be provided, in which a plate-shaped member for preventing a heat medium from flowing into a tube in a certain region can be easily arranged at a position shifted from a center of the tube in a width direction of the tube.

A heat exchanger according to one aspect of the present disclosure performs heat exchange between air and heat medium. The heat exchanger includes tubes, a tank and a prevention plate. The tubes are arranged in a stacking direction and being tubular members having flow paths through which the heat medium passes. The tank is a container that supplies the heat medium to each of the tubes. An end portion of the tank in the stacking direction has an opening as an inlet for the heat medium. The prevention plate has a plate shape and is arranged inside the tank. The prevention plate contacts end surfaces of the tubes within a certain region to prevent the heat medium from flowing into the tubes in the certain region. A width direction is defined as a direction perpendicular to the stacking direction and parallel to a direction of air flowing between the tubes. More than one of the flow paths are formed in each of the tubes and arranged in the width direction. The prevention plate has a deformable portion. The deformable portion is elastically deformable by contacting an edge of the opening of the tank at a time of inserting the prevention plate into the tank through the opening. The deformable portion of the prevention plate that has been inserted into the tank is restored and receives a reaction force from an inner surface of the tank such that the prevention plate is shifted along the width direction by the reaction force.

In the heat exchanger having such a configuration, the prevention plate is arranged inside the tank. The prevention plate is a plate-shaped member arranged inside the tank, and contacts the end surfaces of the tubes to prevent the heat medium from flowing into the tubes within a certain region. The prevention plate is inserted into the tank from the opening.

During insertion of the prevention plate into the tank from the opening, a center of the prevention plate in the width direction substantially coincides in position with centers of the tubes in the width direction. Thereafter, when the insertion of the prevention plate into the tank is completed, the deformable portion that is elastically deformed enters the tank and is restored to the original shape. At this time, a part of the deformable portion receives the reaction force from the inner surface of the tank, and the prevention plate moves along the width direction by the reaction force. As a result, the prevention plate is arranged at a position shifted from the centers of the tubes in the width direction.

A worker can easily arrange the prevention plate at the position shifted from the centers as described above only by inserting the prevention plate from the opening along the stacking direction.

According to the present disclosure, the heat exchanger is provided, in which the plate-shaped member for preventing the heat medium from flowing into the tubes in a certain region can be easily arranged at the position shifted from the centers of the tubes in the width direction.

Hereinafter, embodiments will be described referring to drawings. To facilitate understanding, In order to facilitate understanding of the description, the same components will be assigned the same reference signs as much as possible in each drawing, and duplicate description will be omitted.

A first embodiment will be described. A heat exchanger 10 according to the present embodiment is a heat exchanger for exchanging heat between air and a heat medium, and is configured as a so-called "heater core" provided in a vehicle air conditioner. In the heat exchanger 10, high-temperature cooling water supplied from the outside is used as a heat medium, and air is heated by heat exchange with the heat medium. As illustrated in FIG. 1, the heat exchanger 10 includes an inlet-side tank 100, an outlet-side tank 200, tubes 300, and fins 400.

The inlet-side tank 100 is a container for receiving a heat medium supplied from the outside and distributing and supplying the heat medium to each tube 300. The inlet-side tank 100 is formed as an elongated container having a substantially columnar shape, and is arranged with its longitudinal direction along the horizontal direction. The inlet-side tank 100 includes a header plate 110, a tank plate 120, and a joint portion 130.

Figure 3:
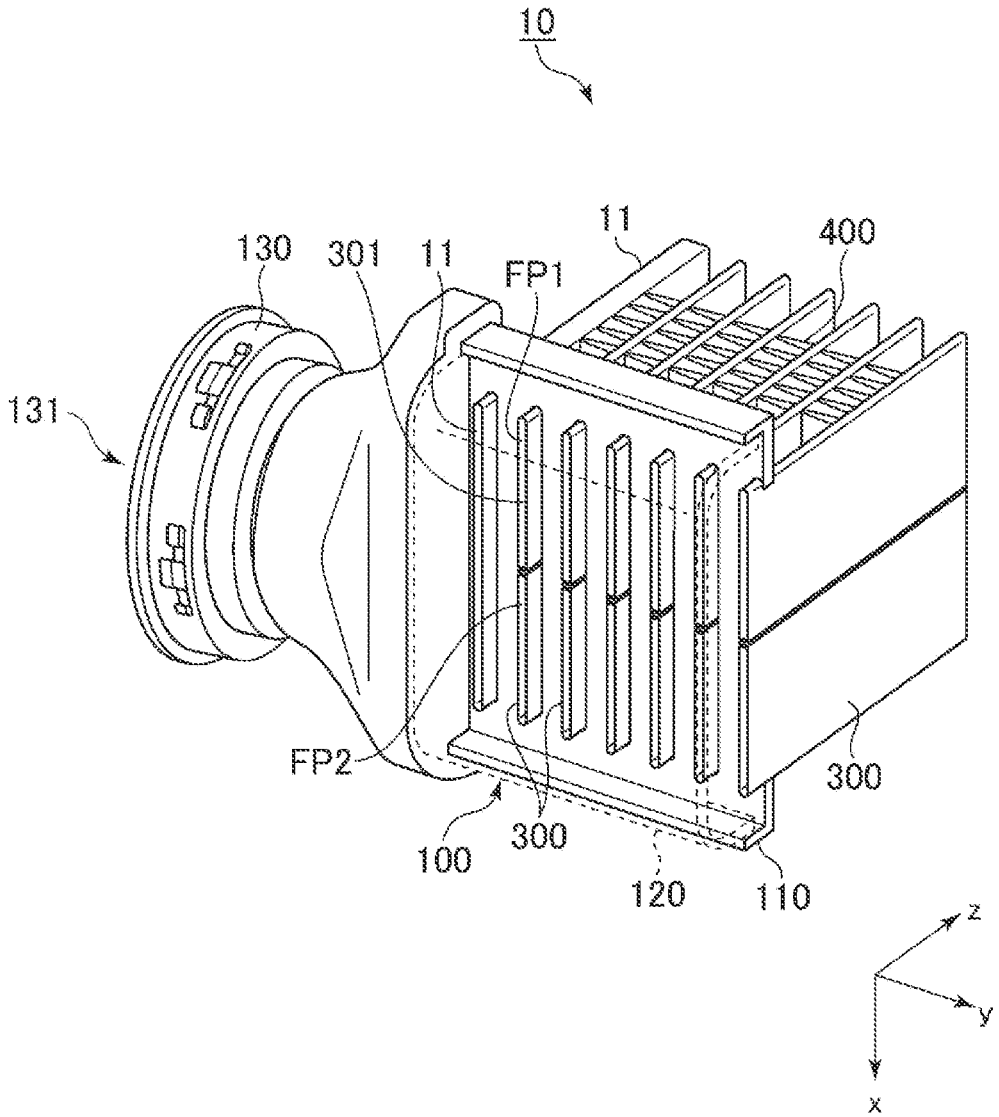
FIG. 3 is a diagram illustrating a configuration of an inside of a tank of the heat exchanger.

The header plate 110 is a substantially flat plate-shaped member. The header plate 110 is made of metal. As illustrated in FIG. 3, a plurality of through holes are formed in the header plate 110, and lower end portions of the tubes 300 are inserted into the through holes from above. The edge portions of the through holes of the header plate 110 and the outer peripheral surfaces of the tubes 300 are watertightly brazed to each other over the entire circumference.

The tank plate 120 is a member for partitioning a space for storing the heat medium. The tank plate 120 is arranged so as to cover the header plate 110 from below, that is, from the side opposite to the tube 300. The tank plate 120 is made of metal. The tank plate 120 and the header plate 110 are watertightly brazed to each other. As a result, the heat medium is prevented from leaking to the outside from between the two.

The joint portion 130 receives a heat medium supplied from the outside and guides the heat medium to the space inside the inlet-side tank 100. A pipe (not illustrated) for supplying a heat medium to the heat exchanger 10 is connected to the joint portion 130. The joint portion 130 is provided at an end portion of the inlet-side tank 100 in the longitudinal direction thereof. An opening 131 which is an inlet for the heat medium is formed at an end portion of the joint portion 130 along the same direction. The heat medium supplied from the outside to the joint portion 130 through the opening 131 is distributed to each tube 300 while flowing inside the inlet-side tank 100 along the longitudinal direction.

The outlet-side tank 200 is a container for receiving the heat medium passing through each tube 300 and discharging the heat medium to the outside. The outlet-side tank 200 is arranged at a position vertically above the inlet-side tank 100. The outlet-side tank 200 includes a header plate 210, a tank plate 220, and a joint portion 230.

The header plate 210 is a substantially flat plate-shaped member. The header plate 210 is made of metal. The shape of the header plate 210 is substantially the same as the shape of the header plate 110 illustrated in FIG. 3. A plurality of through holes are formed in the header plate 210, and upper end portions of the tubes 300 are inserted into the through holes from below. The edge portions of the through holes of the header plate 210 and the outer peripheral surfaces of the tubes 300 are watertightly brazed to each other over the entire circumference.

The tank plate 220 is a member for partitioning a space for storing the heat medium. The tank plate 220 is arranged so as to cover the header plate 210 from above, that is, from the side opposite to the tube 300. The tank plate 220 is made of metal. The tank plate 220 and the header plate 210 are watertightly brazed to each other. As a result, the heat medium is prevented from leaking to the outside from between the two.

The joint portion 230 is a portion configured as an outlet for discharging the heat medium stored in the outlet-side tank 200 to the outside. A pipe (not illustrated) for discharging the heat medium from the heat exchanger 10 is connected to the joint portion 230. The joint portion 230 is provided at a position corresponding to an end portion of the outlet-side tank 200 along the longitudinal direction. An opening 231 which is an outlet for the heat medium is formed at an end portion of the joint portion 230 along the same direction. The heat medium supplied to the inside of the outlet-side tank 200 through each tube 300 flows inside the outlet-side tank 200 along the longitudinal direction, and then is discharged from the joint portion 230 to the outside.

The tube 300 is a tubular member in which a flow path through which the heat medium passes is formed. A plurality of tubes 300 are provided in the heat exchanger 10. Each tube 300 is arranged at a position between the inlet-side tank 100 and the outlet-side tank 200 with its longitudinal direction extending along the vertical direction. The tubes 300 are stacked together with the fins 400 to be described later, and are arranged to be aligned along the longitudinal direction of the inlet-side tank 100 and the outlet-side tank 200. For this reason, the direction in which the plurality of stacked tubes 300 are aligned is hereinafter also referred to as a "stacking direction". The stacking direction is the left-right direction in FIG. 1.

In the inlet-side tank 100, the position where the opening 131 described above is formed can be referred to as a "position corresponding to an end portion along the stacking direction" in the inlet-side tank 100. Similarly, the position where the opening 231 is formed in the outlet-side tank 200 can be referred to as a "position corresponding to an end portion along the stacking direction" in the outlet-side tank 200. As illustrated in FIG. 1, the opening 231 is provided on the same side as the opening 131 in the inlet-side tank 100.

As described above, the lower end of the tube 300 is connected to the header plate 110 of the inlet-side tank 100, and the upper end of the tube 300 is connected to the header plate 210 of the outlet-side tank 200. The internal space of the inlet-side tank 100 and the internal space of the outlet-side tank 200 communicate with each other by the flow path formed in the tube 300. A specific configuration of the tube 300 will be described later.

The fin 400 is a corrugated fin formed by bending a metal plate in a wave shape. A plurality of fins 400 are provided in the heat exchanger 10, and are arranged between the tubes 300. The fins 400 are in abutment on and brazed to each of the pair of tubes 300 arranged on both sides thereof.

In the heat exchanger 10, a portion where the tubes 300 and the fins 400 are alternately stacked as described above is a portion where heat exchange is performed between the heat medium passing through the inside of the tube 300 and the air passing through the outside of the tube 300, and is a portion referred to as a so-called "heat exchange core portion". In the heat exchange core portion, side plates 11 and 12 are arranged at end portions on both left and right sides in FIG. 1.

The side plates 11 and 12 are plate-shaped members formed by bending a metal plate, and are arranged to extend along the same direction as the longitudinal direction of the tube 300. The side plate 11 is arranged at a position corresponding to an end portion of the heat exchange core portion closest to the joint portion 130 along the stacking direction. The side plate 12 is arranged at a position corresponding to an end portion of the heat exchange core portion on the most opposite to the joint portion 130 along the stacking direction. The side plates 11 and 12 sandwich the heat exchange core portion from both sides along the stacking direction. Accordingly, rigidity of the heat exchange core portion is enhanced.

When heat exchange is performed by the heat exchanger 10, a heat medium having passed through an internal combustion engine (not illustrated) to have a high temperature is supplied from the opening 131 of the joint portion 130 to the inside of the inlet-side tank 100. The heat medium is supplied to each tube 300 while flowing inside the inlet-side tank 100 along the stacking direction. The heat medium flows upward inside each tube 300 and is supplied into the outlet-side tank 200.

In the vicinity of the heat exchanger 10, a fan (not illustrated) that sends out air so as to pass through the heat exchange core portion is provided. The direction in which the air is sent out by the fan is a direction from the front side toward the back side in the drawing sheet of FIG. 1.

The heat medium is cooled by air when flowing through the flow path formed in the tube 300 as described above. The air, that is, the air sent out by the fan is heated by the heat medium when passing around the tube 300, and increases the temperature thereof. The air is blown into the vehicle interior as conditioned air for heating, for example. The heat medium supplied to the inside of the outlet-side tank 200 through each tube 300 is discharged from the joint portion 230 to the outside as described above.

In FIG. 1, a direction which is the horizontal direction and directed from the front side toward the back side of the drawing sheet is defined as the x direction, and the x axis is set along the same direction. The x direction is a direction in which air passes through the heat exchanger 10 as described above.

In FIG. 1, a direction which is the horizontal direction and directed from the joint portion 130 toward the inside of the inlet-side tank 100 is defined as the y direction, and the y axis is set along the same direction. The stacking direction is a direction along the y axis.

Further, in FIG. 1, a direction perpendicular to both the x direction and the y direction and directed from the inlet-side tank 100 toward the outlet-side tank 200 is defined as the z direction, and the z axis is set along the z direction.

Hereinafter, the configuration of the heat exchanger 10 will be described using the x direction, the y direction, the z direction, the x axis, the y axis, and the z axis defined as described above.

Figure 2:
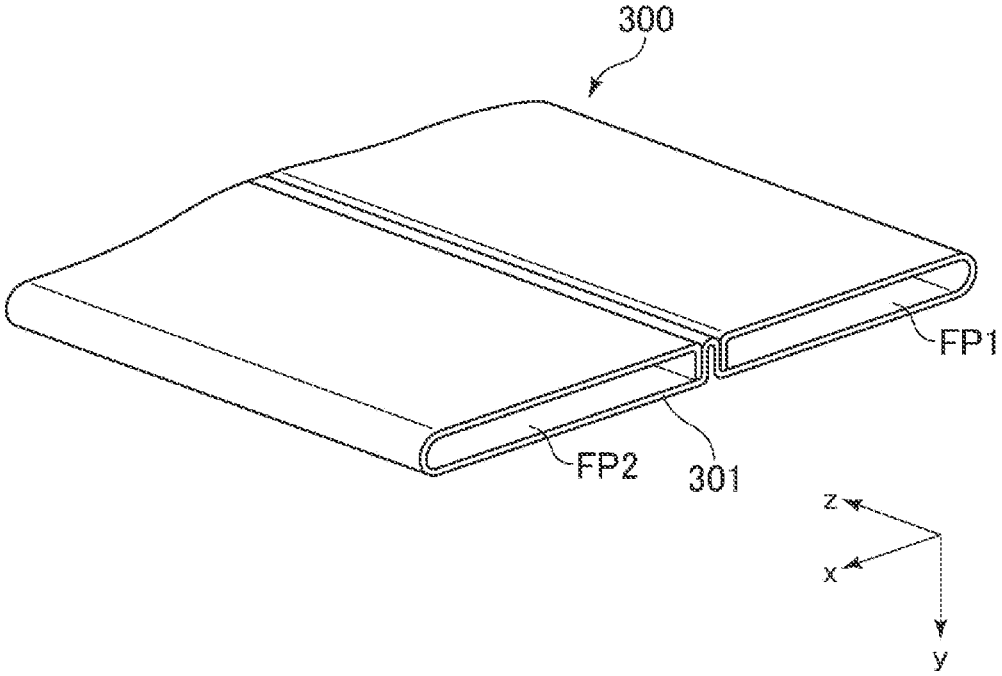
FIG. 2 is a diagram illustrating a configuration of a tube included in the heat exchanger.

A specific configuration of the tube 300 will be described with reference to FIG. 2. FIG. 2 is a perspective view illustrating a portion of the tube 300 in the vicinity of the end portion on the −z direction side. As illustrated in the drawing, a first flow path FP1 and a second flow path FP2 are formed inside the tube 300 as flow paths through which the heat medium flows. These are formed to extend linearly along the longitudinal direction of the tube 300, that is, the z direction.

The tube 300 in the present embodiment is formed by bending one metal plate. The tube 300 has a flat cross section perpendicular to the longitudinal direction. The first flow path FP1 is formed in a portion of the tube 300 on the −x direction side. The second flow path FP2 is formed in a portion of the tube 300 on the x direction side. A partition formed by bending the metal plate separates the first flow path FP1 and the second flow path FP2 from each other. The partition and a portion where the end portions of the metal plate overlap each other are watertightly brazed.

The x direction in which the first flow path FP1 and the second flow path FP2 are aligned is a direction perpendicular to the stacking direction and parallel to the direction in which air passes along the tube 300. Since the x direction is a direction along the width of the tube 300, hereinafter, the x direction is also referred to as a "width direction". In each tube 300, the first flow path FP1 and the second flow path FP2, which are flow paths through which the heat medium passes, are formed to be aligned along the width direction.

In the present embodiment, the partition is formed at a position corresponding to the center of the tube 300 along the width direction. Therefore, the dimension of the first flow path FP1 along the width direction is equal to the dimension of the second flow path FP2 along the width direction. In the present embodiment, the cross-sectional shape of the first flow path FP1 and the cross-sectional shape of the second flow path FP2 are symmetrical to each other.

The tube 300 having the first flow path FP1 and the second flow path FP2 may have an aspect different from that described above. For example, the tube 300 may be formed by metal extrusion. In addition, the tube 300 having the first flow path FP1 and the second flow path FP2 may be configured by aligning two independent tubular members along the width direction. In this case, the entire two aligned tubular members correspond to one "tube 300". Further, an aspect may be adopted in which a flow path different from the first flow path FP1 and the second flow path FP2 is formed in the tube 300. That is, the number of flow paths formed to be aligned along the width direction in the tube 300 may be three or more.

Figure 4:
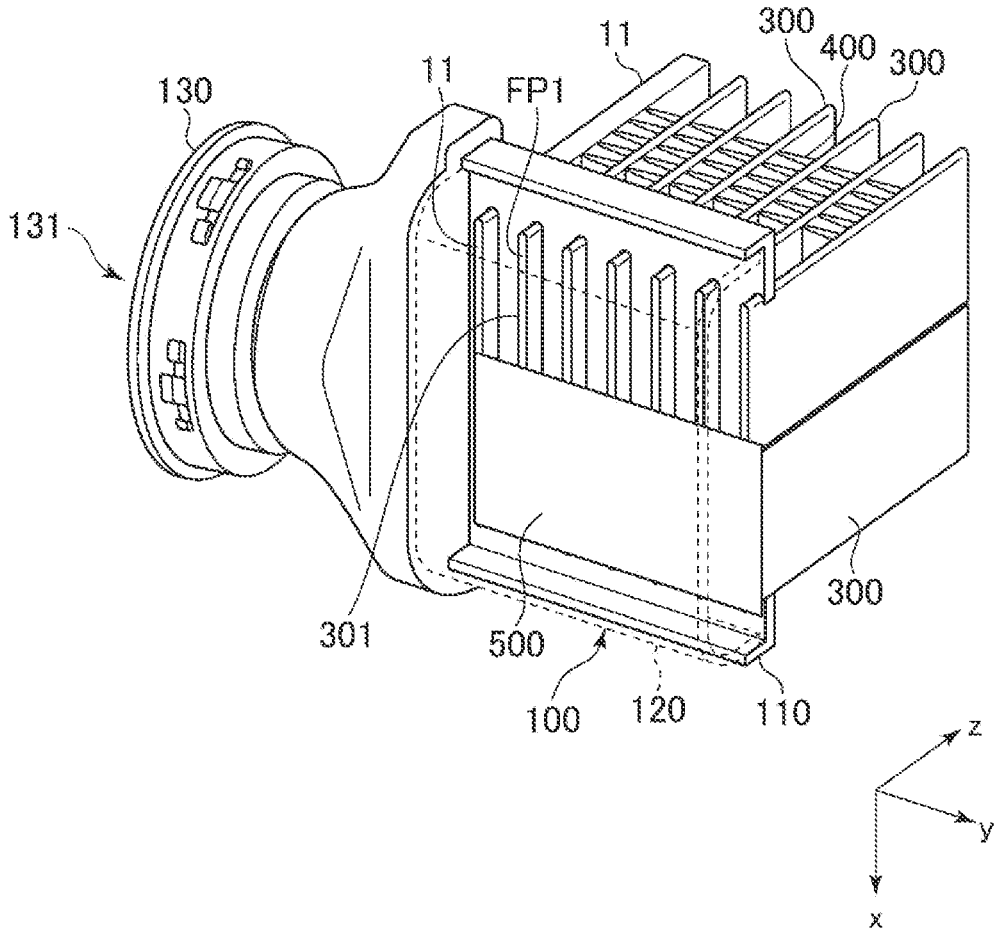
FIG. 4 is a diagram illustrating the configuration of the inside of the tank of the heat exchanger.

FIGS. 3 and 4 illustrate the internal configuration of the inlet-side tank 100 in the vicinity of the joint portion 130. As illustrated in FIG. 4, a prevention plate 500 is arranged inside the inlet-side tank 100, but is not illustrated in FIG. 3.

As illustrated in FIG. 3, inside the inlet-side tank 100, the tip portion of the tube 300 protrudes in the −z direction from the header plate 110. The protrusion amounts are equal to each other for all the tubes 300. Therefore, the end surfaces of the tubes 300 are arranged on the same plane. The arrangement is merely design. Actually, a part or all of the end surfaces may be slightly shifted from the above plane due to dimensional variations of the components or the like.

The "end surface", that is, the distal end surface of the tube 300 on the −z direction side is hereinafter also referred to as an "end surface 301".

Figure 7:
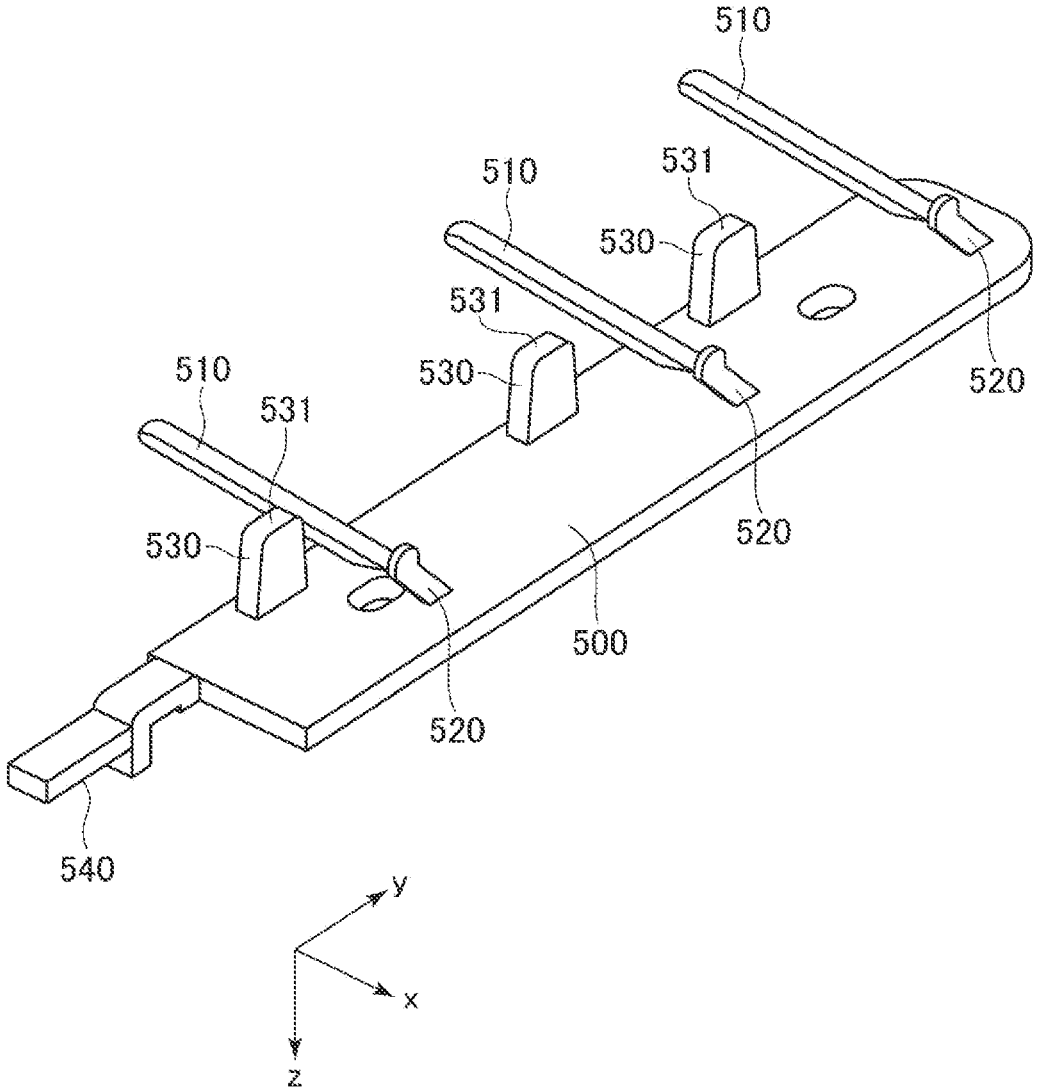
FIG. 7 is a diagram illustrating a configuration of the prevention plate arranged inside the tank.

As illustrated in FIG. 4, the prevention plate 500 is arranged inside the inlet-side tank 100. The prevention plate 500 is a flat plate-shaped member having a substantially rectangular shape as viewed along the z-axis. The prevention plate 500 is arranged with its long side extending in the y direction, that is, the stacking direction. In other words, the prevention plate 500 is arranged to extend along the stacking direction. As illustrated in FIG. 7, first deformable portions 510, second deformable portions 520, ribs 530, and the like are formed in the prevention plate 500, but these are not illustrated in FIG. 4. A specific shape of the prevention plate 500 will be described later with reference to FIG. 7 and the like.

The prevention plate 500 is arranged with its main surface on the z direction side in abutment on the end surfaces 301 of all the tubes 300. The end surface 301 of the tube 300 is formed with openings that are end portions of the first flow path FP1 and the second flow path FP2, but inflow of the heat medium into the respective flow paths is prevented in a region covered by the prevention plate 500. The prevention plate 500 is provided to prevent the heat medium from flowing into at least one of the first flow path FP1 and the second flow path FP2 in a certain region along the width direction.

In the present embodiment, the prevention plate 500 covers the entire inlet of the second flow path FP2 and a part of the inlet of the first flow path FP1. In the present embodiment, the term "prevent" means that the inflow of the heat medium in the portion is completely blocked. A slight gap may be formed between the prevention plate 500 and the end portions of the tubes 300 due to deflection of the surface of the prevention plate 500 or the like, or a small amount of heat medium may flow into the second flow path FP2 or the like from the gap. However, in order to sufficiently achieve an effect of preventing the flow of the heat medium by the prevention plate 500 and an effect of reducing the inequality in flow rate of the heat medium flowing into the tubes 300, the size of the gap is preferably 1 mm or less at the maximum.

The arrangement of the prevention plate 500 will be described with reference to FIGS. 5A and 5B. A region W1 illustrated in FIG. 5B is a region along the width direction of the entire flow path including the first flow path FP1 and the second flow path FP2. A position indicated by an arrow AR1 in FIG. 5B is a center position of the region W1 along the width direction.

A region W2 illustrated in FIG. 5B is a region along the width direction of a portion where the flow of the heat medium is prevented by the prevention plate 500 in the entire flow path. A position indicated by an arrow AR2 in FIG. 5B is a center position of the region W2 along the width direction.

In the present embodiment, the prevention plate 500 is arranged at a position closer to the x direction along the width direction. Therefore, the center position indicated by the arrow AR2 is different from the entire center position indicated by the arrow AR1.

The prevention plate 500 is provided to increase the flow resistance of the heat medium flowing through the tube 300, thereby reducing the inequality in the flow rate of the heat medium flowing into the tubes 300. In the present embodiment, the two center positions do not coincide with each other, but are different from each other, thereby further increasing the flow resistance.

Figure 6:
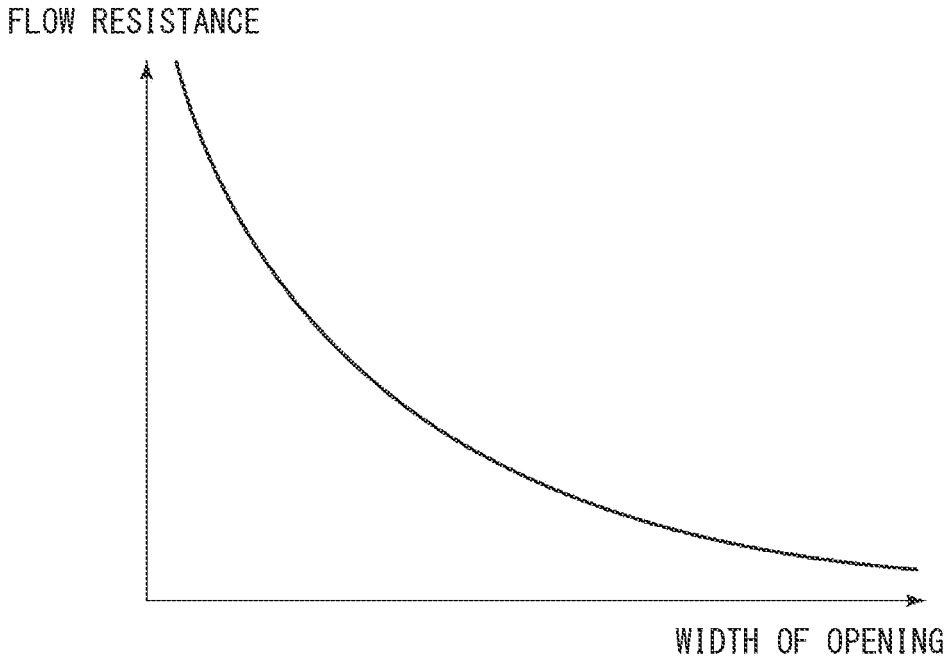
FIG. 6 is a diagram illustrating a relationship between a width of an opening in a flow path of a tube and a flow resistance of a heat medium flowing through the flow path.

The reason why the flow resistance increases will be described with reference to FIG. 6. FIG. 6 shows the relationship between the width (horizontal axis) of the opening along the width direction in one flow path and the flow resistance (vertical axis) of the flow path. The width of the opening along the horizontal axis may be referred to as an opening area of a portion of the flow path not closed by the prevention plate 500.

As illustrated in the drawing, the relationship between the width of the opening and the flow resistance is not a linear relationship. When the width of the opening is further narrowed from a state where the width is narrowed to some extent, the flow resistance tends to increase rapidly. On the other hand, even when the width of the opening is further increased from a state where the width is increased to some extent, the flow resistance is only slightly decreased.

Therefore, as compared with the case where the center position indicated by the arrow AR2 in FIG. 5B coincides with the entire center position indicated by the arrow AR1, that is, the case where the prevention plate 500 blocks the center of the tube 300, in the present embodiment, the flow resistance in the first flow path FP1 slightly decreases, while the flow resistance in the second flow path FP2 greatly increases. For this reason, the flow resistance in the entire one tube 300 is larger by shifting the position of the prevention plate 500 to the x direction side than when not shifting.

On the inner side of the inlet-side tank 100, a difference in the pressure of the heat medium tends to occur between a portion on the −y direction side close to the joint portion 130 and a portion on the y direction side far from the joint portion 130. Therefore, when the flow resistance in each tube 300 is small, the flow rate of the heat medium flowing into each tube 300 tends to greatly vary for each tube 300 due to the pressure difference. Specifically, the flow rate of the heat medium in the tube 300 close to the joint portion 130 tends to increase, and the flow rate of the heat medium in the tube 300 far from the joint portion 130 tends to decrease.

On the other hand, in the heat exchanger 10 according to the present embodiment, the flow resistance in each tube 300 is increased by shifting the position of the prevention plate 500 to the x direction side as described above. As a result, even if a pressure difference of the heat medium occurs inside the inlet-side tank 100, the inequality in the flow rate of the heat medium flowing into the tubes 300 can be reduced.

Figure 8:
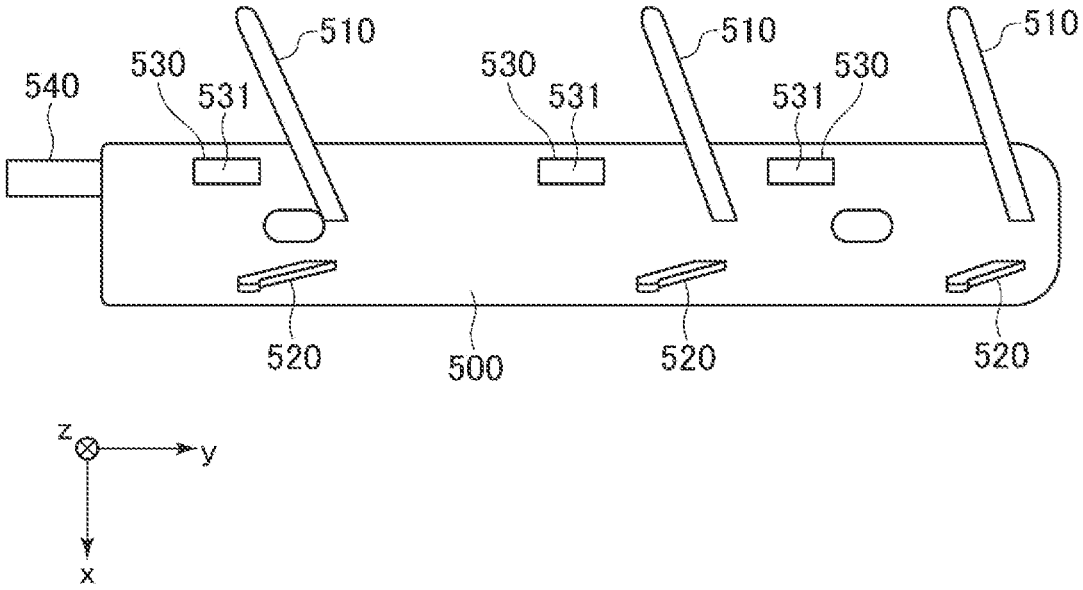
FIG. 8 is a diagram illustrating the configuration of the prevention plate arranged inside the tank.
Figure 9:
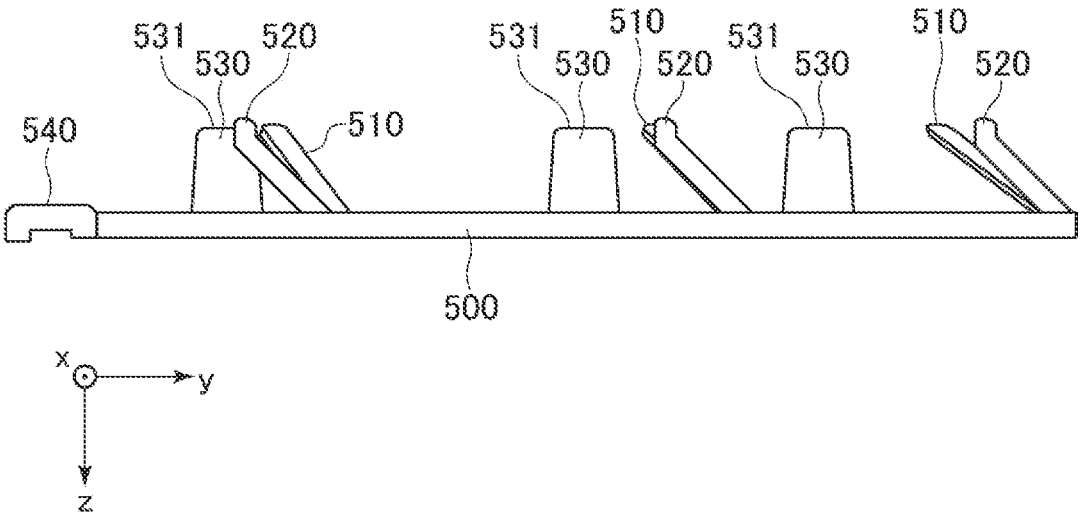
FIG. 9 is a diagram illustrating the configuration of the prevention plate arranged inside the tank.

A specific shape of the prevention plate 500 will be described with reference to FIGS. 7, 8, and 9. In FIG. 7, the configuration of the prevention plate 500 is illustrated by a perspective view. FIG. 8 illustrates a state in which the prevention plate 500 is viewed from the −z direction side. FIG. 9 illustrates a state in which the prevention plate 500 is viewed from the x direction side. The dimension along the widthwise direction of the prevention plate 500, that is, the x direction in FIG. 7 and the like is slightly smaller than the inner diameter of the opening 131.

The prevention plate 500 is provided with the first deformable portions 510, the second deformable portions 520, the ribs 530, and a handle 540. The entire prevention plate 500 including the first deformable portions 510 is integrally formed of resin.

The first deformable portion 510 is formed as a rod-shaped portion extending substantially linearly from the surface of the prevention plate 500 on the −z-direction side, that is, the surface facing the tank plate 120 toward the tank plate 120. The direction in which the first deformable portion 510 extends is a direction toward the −y direction side and toward the −x direction side as the first deformable portion 510 goes toward the −z direction side. In the present embodiment, three first deformable portions 510 are provided, and the three first deformable portions 510 are provided so as to be aligned along the stacking direction.

Similarly to the first deformable portion 510, the second deformable portion 520 is formed as a rod-shaped portion extending substantially linearly from the surface of the prevention plate 500 on the −z-direction side toward the tank plate 120. The direction in which the second deformable portion 520 extends is a direction toward the −y direction side and toward the x direction side as the second deformable portion 520 goes toward the −z direction side. In the present embodiment, three second deformable portions 520 are provided, and the three second deformable portions 520 are provided so as to be aligned along the stacking direction. The y coordinate of the root portion of each of the second deformable portions 520 is substantially equal to the y coordinate of the root portion of each of the first deformable portions 510.

Since the first deformable portion 510 and the second deformable portion 520 are elongated rod-shaped portions formed of resin, the first deformable portion 510 and the second deformable portion 520 are easily elastically deformed by receiving an external force. The first deformable portion 510 and the second deformable portion 520 correspond to a "deformable portion" in the present embodiment.

In the present embodiment, the length of the first deformable portion 510 and the length of the second deformable portion 520 are different from each other, and the first deformable portion 510 is longer. As illustrated in FIG. 8, when viewed along the longitudinal direction of the tube 300, the first deformable portion 510 largely protrudes from the prevention plate 500 in the −x direction. On the other hand, the entire second deformable portion 520 is accommodated inside the prevention plate 500, and the amount of protrusion in the x direction is small.

The rib 530 is formed as a plate-like portion linearly extending in the −z direction from the surface of the prevention plate 500 on the −z direction side. The rib 530 has a sufficient thickness, and almost no elastic deformation occurs even when the rib 530 receives an external force. The thickness of the rib 530 (that is, the dimension along the x direction) is preferably about the same as or larger than the thickness of the prevention plate 500 (that is, the dimension along the z direction). A flat surface 531 is formed at the end portion of the rib 530, that is, at the end in the −z direction. The flat surface 531 is a surface parallel to the main surface of the prevention plate 500.

In the present embodiment, three ribs 530 are provided, and the three ribs 530 are provided so as to be aligned along the stacking direction. As illustrated in FIG. 7, each rib 530 is provided at a position closer to the −x direction side than the center along the x direction on the surface of the prevention plate 500 on the −z direction side.

The handle 540 is a substantially rod-shaped portion formed to extend further along the −y direction side from an end portion of the prevention plate 500 on the −y direction side. The handle 540 is a portion gripped by an operator when the operator performs an operation of inserting the prevention plate 500 into the inlet-side tank 100.

The operation of inserting the prevention plate 500 into the inlet-side tank 100 will be described. The prevention plate 500 is inserted into the inlet-side tank 100 from the opening 131 after the entire heat exchanger 10 is formed by brazing.

Figure 10:
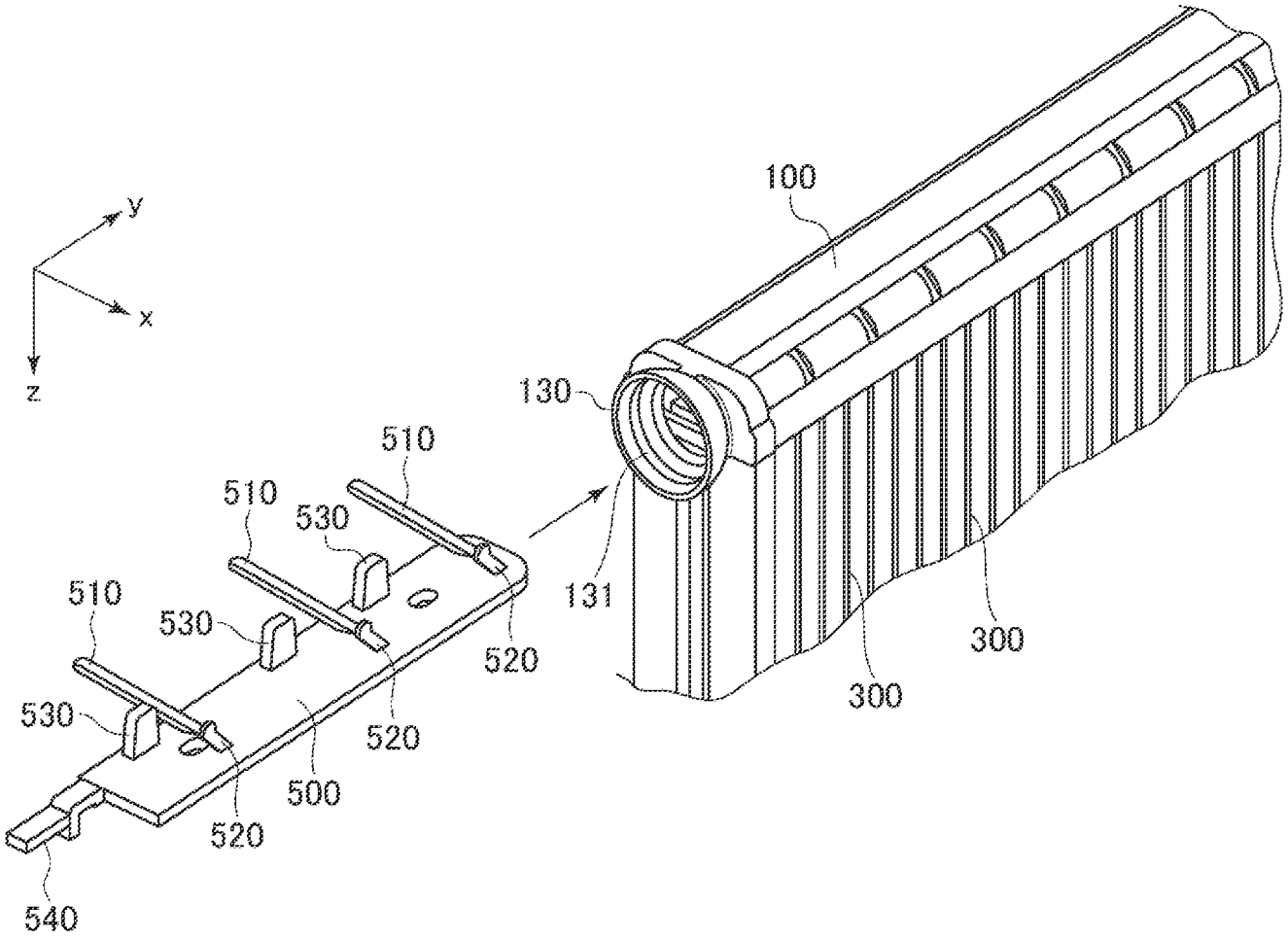
FIG. 10 is a diagram illustrating a state when the prevention plate is inserted from an opening of the tank.

FIG. 10 illustrates a state when the prevention plate 500 is inserted from the opening 131 as described above. As illustrated in the drawing, the prevention plate 500 is inserted into the inlet-side tank 100 through the opening 131 from the end portion opposite to the handle 540 in a state where the longitudinal direction thereof is along the longitudinal direction of the inlet-side tank 100.

The x coordinate of the center of the opening 131 is substantially equal to the x coordinate of the position corresponding to the center of the tube 300 along the x direction. Therefore, in a stage in which the prevention plate 500 is passing through the opening 131, the x coordinate of the position corresponding to the center of the prevention plate 500 along the x direction is substantially equal to the x coordinate of the position corresponding to the center of the tube 300 along the x direction. That is, the center position indicated by the arrow AR1 in FIG. 5B and the center position indicated by the arrow AR2 in FIG. 5B substantially coincide with each other during the insertion of the prevention plate 500.

As described above, the first deformable portion 510 largely protrudes from the prevention plate 500 in the −x direction. Therefore, in the process in which the prevention plate 500 passes through the opening 131, a part of the protruding first deformable portion 510 hits the edge of the opening 131. However, since the first deformable portion 510 is an elongated rod-shaped portion formed of resin, the first deformable portion 510 is elastically deformed by receiving a force from the edge of the opening 131. Specifically, the first deformable portion 510 is elastically deformed so as to fall to the −y direction side. Therefore, the operation of inserting the prevention plate 500 into the inlet-side tank 100 is not hindered by the first deformable portion 510.

Similarly to the above, the second deformable portion 520 is also elastically deformed so as to fall to the −y direction side when hitting the edge of the opening 131. Therefore, the operation of inserting the prevention plate 500 into the inlet-side tank 100 is not hindered by the second deformable portion 520.

Figure 11:
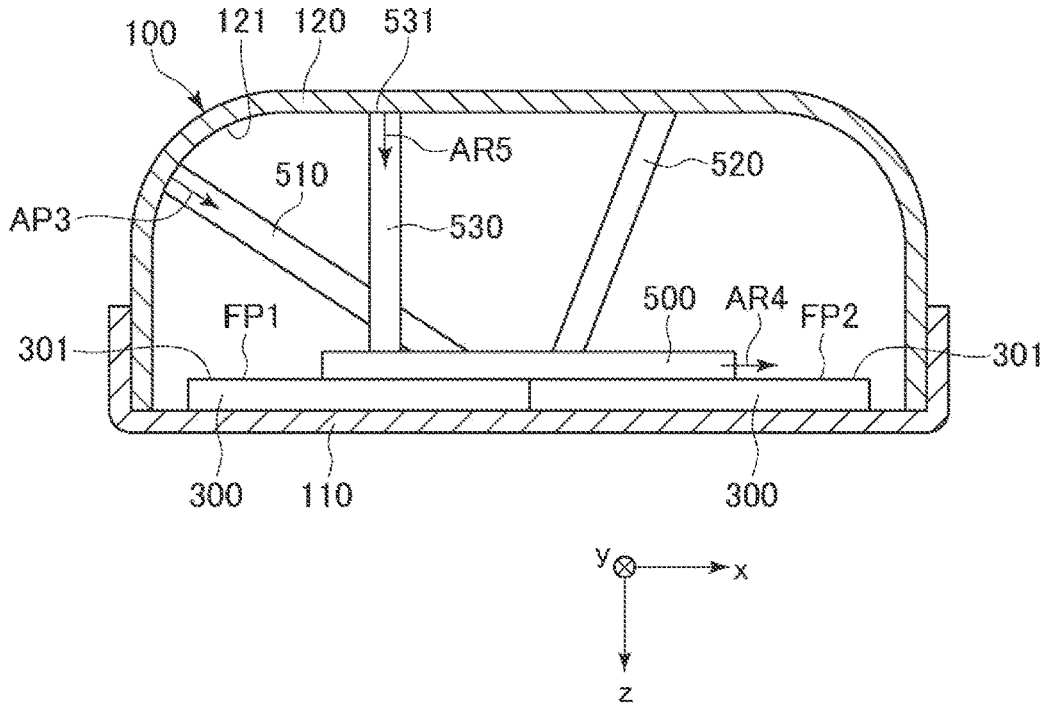
FIG. 11 is a diagram for explaining movement of the prevention plate inside the tank.

FIG. 11 schematically illustrates a state in which the prevention plate 500 is partially inserted into the inlet-side tank 100. The first deformable portion 510 illustrated in FIG. 11 is one of the plurality of first deformable portions 510 provided and previously inserted into the inlet-side tank 100. The first deformable portion 510 is elastically deformed in advance against the edge of the opening 131, and then is to be restored to the original shape when entering the inlet-side tank 100.

However, as illustrated in FIG. 11, while the prevention plate 500 is at the center along the x direction, the first deformable portion 510 cannot be completely restored to the original shape, and the tip of the first deformable portion 510 is in a state of abutting on an inner surface 121 of the inlet-side tank 100. At this time, since the first deformable portion 510 is still elastically deformed, a reaction force as indicated by an arrow AR3 is received from the inner surface 121.

The reaction force has a component in the x direction and is transmitted to the prevention plate 500 via the first deformable portion 510. Therefore, a force as indicated by an arrow AR4 in FIG. 11 is applied to the prevention plate 500. However, since the prevention plate 500 is only partially inserted into the inlet-side tank 100, the prevention plate does not move in the direction of the arrow AR4 at this time.

Thereafter, when the prevention plate 500 is further inserted deeper along the stacking direction and entirely enters the inside of the inlet-side tank 100, the prevention plate 500 starts to move in the direction of the arrow AR4 by the reaction force. That is, the prevention plate 500 starts to move in the x direction along the width direction.

Figure 12:
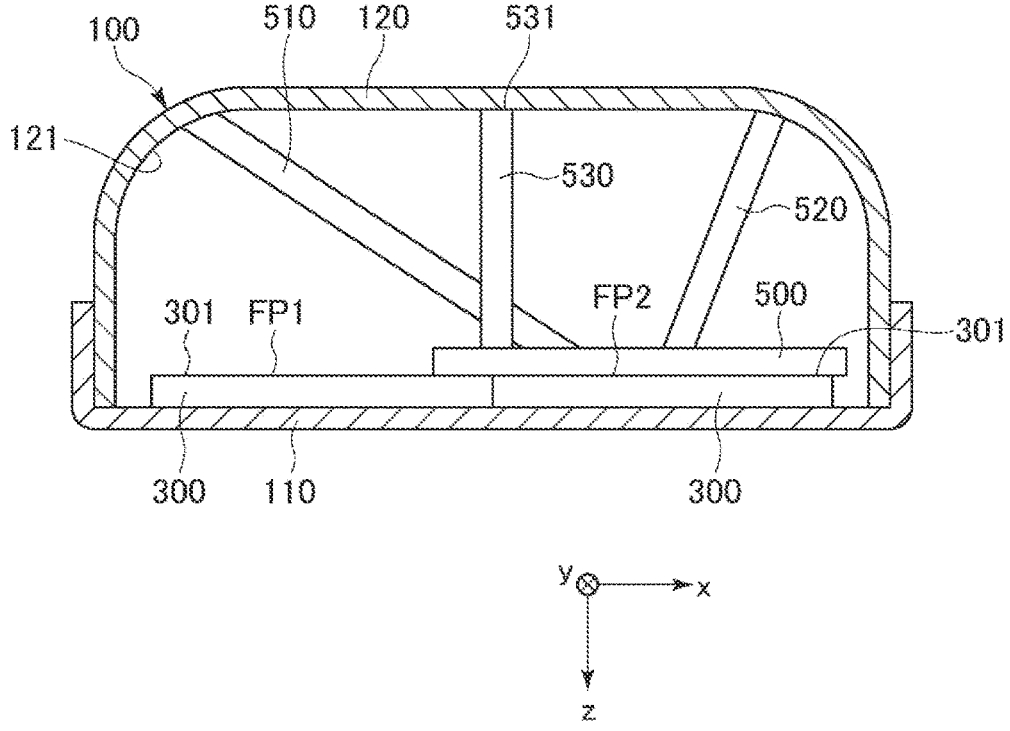
FIG. 12 is a diagram for explaining movement of the prevention plate inside the tank.

The second deformable portion 520 is immediately restored to its substantially original shape in the inlet-side tank 100 even in a stage in which the prevention plate 500 is being inserted into the inlet-side tank 100, and its distal end is brought into abutment on the inner surface 121 of the inlet-side tank 100. Thereafter, when the prevention plate 500 moves in the x direction by the restoring force of the first deformable portion 510, the distal end of the second deformable portion 520 reaches a portion where the inner surface 121 is a curved surface from the flat surface, whereby the movement of the prevention plate 500 is terminated. At this time, the shapes of the first deformable portion 510 and the second deformable portion 510 are adjusted so that the first deformable portion 520 is restored to the original shape. FIG. 12 schematically illustrates a state in which the movement of the prevention plate 500 in the x direction is completed similarly to FIG. 11. When the movement of the prevention plate 500 is completed, the x coordinate of the rib 530 substantially coincides with the x coordinate of the center position of the tube 300 in the x direction.

Meanwhile, when the prevention plate 500 moves in the x direction, a state in which the main surface of the prevention plate 500 is parallel to the end surface 301 is not maintained, and there is a concern that the prevention plate 500 may be inclined. When the prevention plate 500 is inclined with respect to the end surface 301, the flow path is not blocked by the prevention plate 500 as designed, so that it is not possible to reduce the inequality in the flow rate of the heat medium flowing into the tubes 300.

Therefore, the prevention plate 500 in the present embodiment is provided with the ribs 530 described above in order to prevent the prevention plate 500 from being inclined. As illustrated in FIGS. 11 and 12, inside the inlet-side tank 100, the flat surface 531 of the rib 530 is in abutment on the inner surface 121 of the inlet-side tank 100. Therefore, when the prevention plate 500 is to be inclined during or after the movement, the rib 530 receives a force as indicated by an arrow AR5 from the inner surface 121, and the inclination of the prevention plate 500 is prevented by the reaction force. In the present embodiment, the second deformable portion 520 also exerts a function of preventing the inclination of the prevention plate 500 together with the rib 530.

As described above, in the heat exchanger 10 according to the present embodiment, the prevention plate 500 is arranged inside the inlet-side tank 100, and the prevention plate 500 is provided with the first deformable portions 510 and the second deformable portions 520 as deformable portions. The heat exchanger 10 is configured such that the deformable portions elastically deform by contacting the edge of the opening 131 when the prevention plate 500 is inserted into the inlet-side tank 100 from the opening 131. Furthermore, the heat exchanger 10 is configured such that when the prevention plate 500 is inserted into the inlet-side tank 100, the restored deformable portions receive a reaction force from the inner surface 121 of the inlet-side tank 100, and the prevention plate 500 moves along the width direction by the reaction force.

Figure 5A:
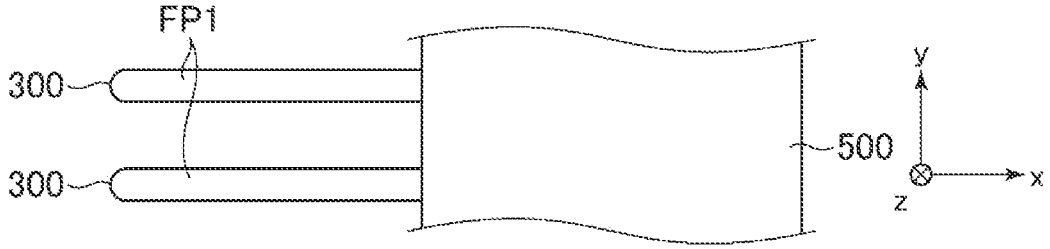
FIG. 5A is a diagram illustrating an arrangement of a prevention plate provided in the heat exchanger.
Figure 5B:
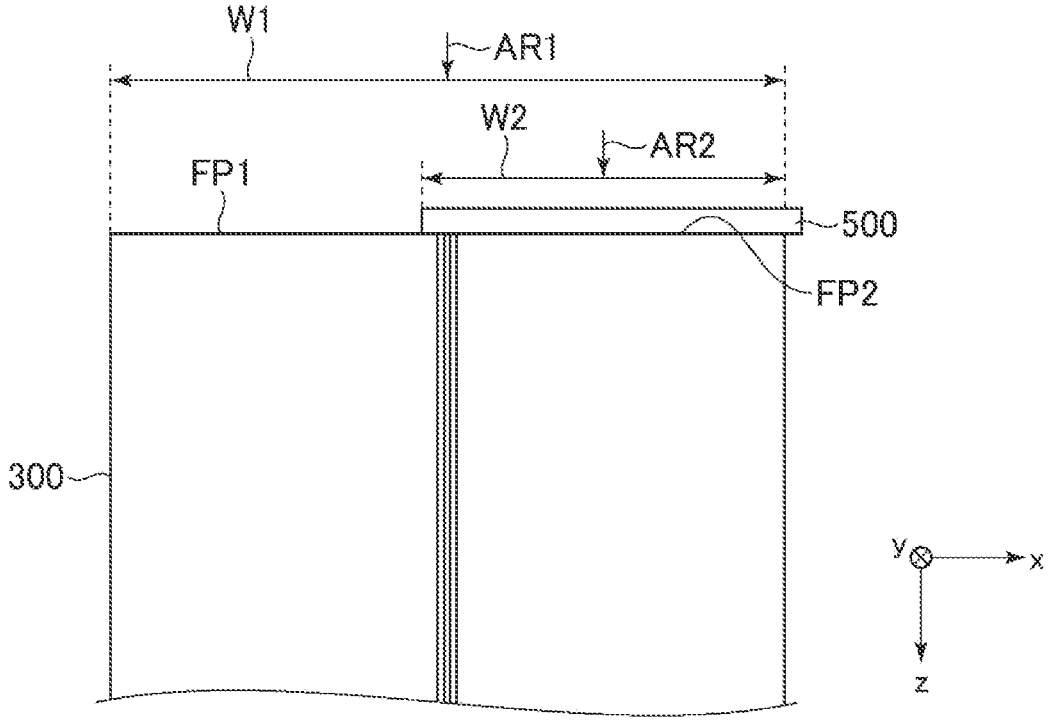
FIG. 5B is a diagram illustrating an arrangement of the prevention plate provided in the heat exchanger.

An operator can easily arrange the prevention plate 500 at a position shifted from the center of the tube 300 in the width direction as illustrated in FIGS. 5A and 5B only by performing an operation of inserting the prevention plate 500 from the opening 131 along the stacking direction.

Both the first deformable portion 510 and the second deformable portion 520, which are deformable portions, are formed as rod-shaped portions extending toward the inner surface 121 of the inlet-side tank 100. Therefore, it is possible to elastically deform the first deformable portion 510 and the like and easily generate a reaction force that moves the prevention plate 500.

The deformable portions include the first deformable portion 510 provided on one side of the prevention plate 500 in the width direction, and the second deformable portion 520 provided on another side of the prevention plate 500 in the width direction. In addition, the length of the first deformable portion 510 and the length of the second deformable portion 520 are different from each other, and the first deformable portion 510 is longer. As a result, since the reaction force generated by the restoration of the first deformable portion 510 is larger than the reaction force generated by the restoration of the second deformable portion, it is possible to reliably generate the force for moving the prevention plate 500 in the x direction.

In the present embodiment, a plurality of, specifically, three first deformable portions 510 and three second deformable portions 520, which are deformable portions, are provided to be aligned along the stacking direction. In such a configuration, a force for moving the prevention plate 500 in the x direction acts on the prevention plate 500 at each of a plurality of locations along the stacking direction. Therefore, the prevention plate 500 can be smoothly translated in the x direction.

In the prevention plate 500, the rib 530 is formed to prevent the prevention plate 500 from being inclined when the prevention plate 500 moves along the width direction inside the inlet-side tank 100. Since the tip of the rib 530 abuts on the inner surface of the inlet-side tank 100, it is possible to reliably prevent the inclination of the prevention plate 500 during or after movement.

The flat surface 531 that abuts on the inner surface 121 of the inlet-side tank 100 is formed at the tip of the rib 530. Since the distal end of the rib 530 abuts on the inner surface 121 on a surface instead of a point or a line, it is possible to more reliably prevent the prevention plate 500 from being inclined.

A plurality of, specifically, three ribs 530 of the present embodiment are provided to be aligned along the stacking direction. In such an aspect, a force that prevents the inclination of the prevention plate 500, that is, a force indicated by the arrow AR5 in FIG. 11 acts on the prevention plate 500 at each of a plurality of locations along the stacking direction. Therefore, the force for preventing the inclination of the prevention plate 500 can be generated in the entire prevention plate 500 along the longitudinal direction.

A second embodiment will be described. The present embodiment is different from the first embodiment only in the aspect of the deformable portion formed on the prevention plate 500. Hereinafter, points different from the first embodiment will be mainly described, and description of points common to the first embodiment will be omitted as appropriate.

Figure 13:
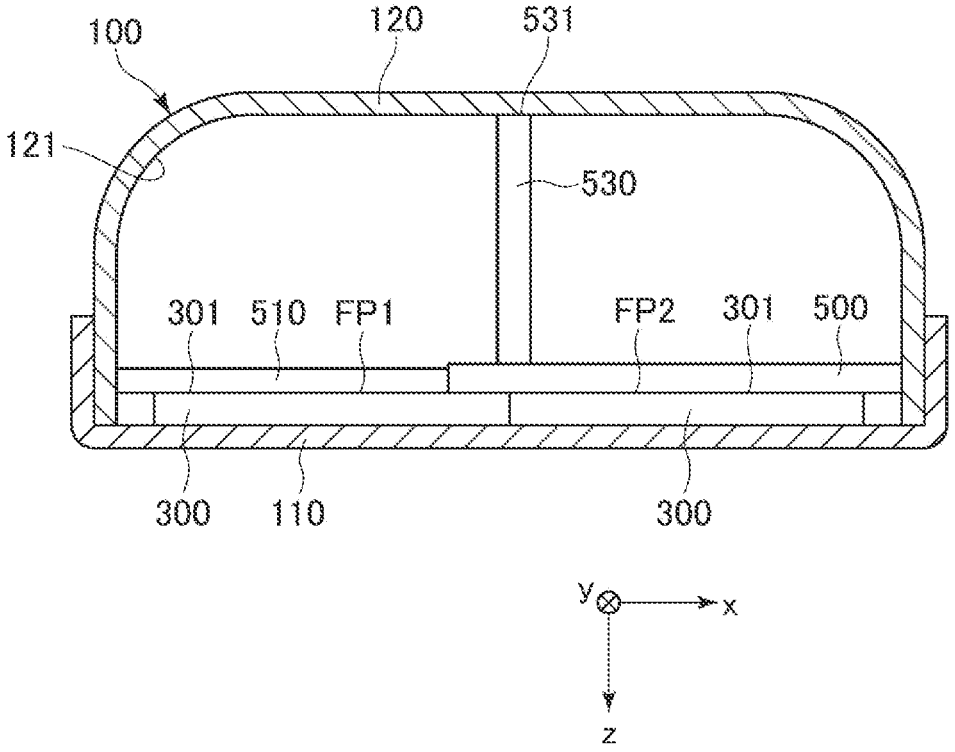
FIG. 13 is a diagram illustrating a configuration of a prevention plate according to a second embodiment.

FIG. 13 illustrates a state in which the prevention plate 500 is inserted into the inlet-side tank 100 of the heat exchanger 10 according to the present embodiment in the same manner as in FIG. 12. As illustrated in FIG. 13, in the prevention plate 500 according to the present embodiment, the first deformable portion 510 and the rib 530 are formed, but the second deformable portion 520 is not formed. The first deformable portion 510 is formed to extend from the side surface of the prevention plate 500 on the −x direction side toward the −x direction side. Specifically, the first deformable portion 510 extends in a direction toward the z direction side as the first deformable portion 510 goes toward the −x direction side.

Also in such an aspect, when the prevention plate 500 is inserted into the inlet-side tank 100, the first deformable portion 510 is once elastically deformed, and the prevention plate 500 moves to the x direction side by its restoring force. As a result, effects similar to those described in the first embodiment are obtained.

A third embodiment will be described. The present embodiment is different from the first embodiment only in the aspect of the rib 530 formed on the prevention plate 500. Hereinafter, points different from the first embodiment will be mainly described, and description of points common to the first embodiment will be omitted as appropriate.

Figure 14:
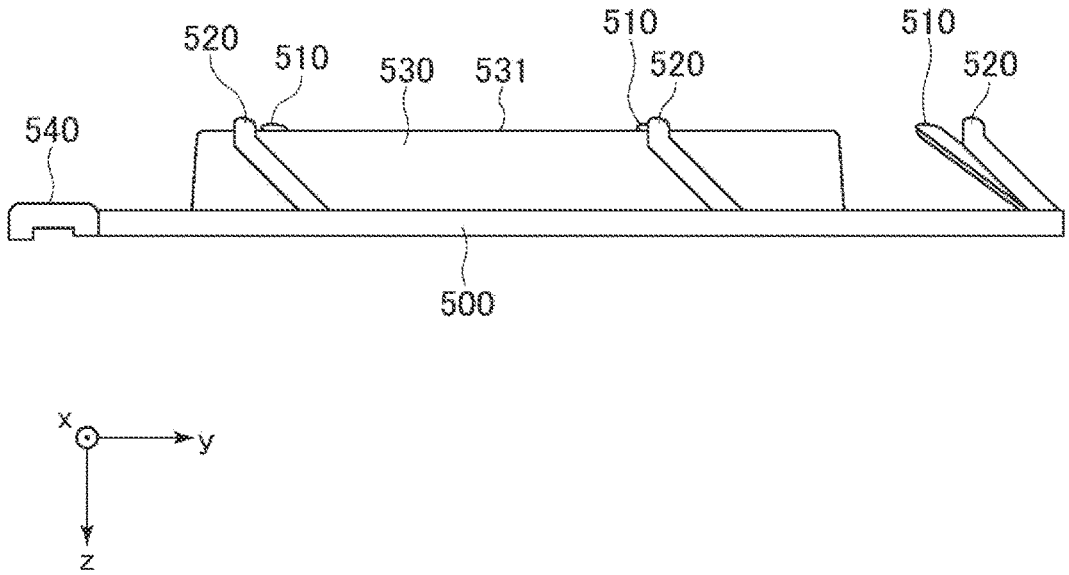
FIG. 14 is a diagram illustrating a configuration of a prevention plate according to a third embodiment.

FIG. 14 illustrates a state in which the prevention plate 500 according to the present embodiment is viewed from the x direction side as in FIG. 9. As illustrated in FIG. 14, in the present embodiment, the dimension of the rib 530 along the y direction is larger than that in the first embodiment, and only one rib 530 having such a shape is provided. Also in such an aspect, effects similar to those described in the first embodiment are obtained.

In the present embodiment, the flat surface 531 that abuts on the inner surface 121 of the inlet-side tank 100 also increases as the dimension of the rib 530 along the y direction increases. For this reason, when the prevention plate 500 is inserted along the stacking direction, the frictional force generated between the inner surface 121 and the flat surface 531 increases, and the insertion operation may be difficult. In view of this point, as in the first embodiment, it is preferable to provide a plurality of small ribs 530 so as to be aligned along the stacking direction.

A fourth embodiment will be described. The present embodiment is different from the first embodiment only in the aspect of the rib 530 formed on the prevention plate 500. Hereinafter, points different from the first embodiment will be mainly described, and description of points common to the first embodiment will be omitted as appropriate.

Figure 15:
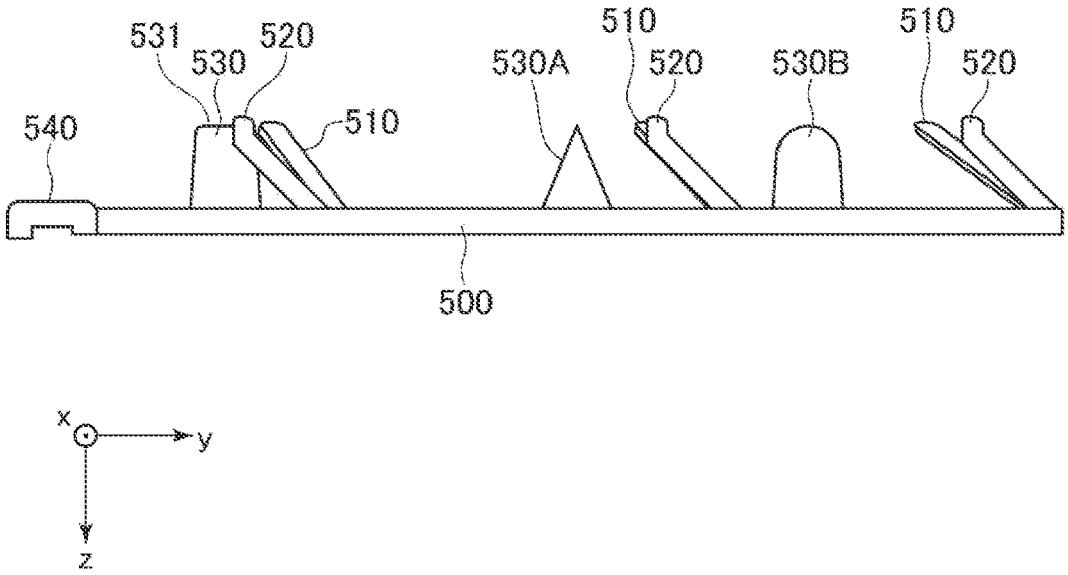
FIG. 15 is a diagram illustrating a configuration of a prevention plate according to a fourth embodiment.

FIG. 15 illustrates a state in which the prevention plate 500 according to the present embodiment is viewed from the x direction side as in FIG. 9. As illustrated in FIG. 15, also in the present embodiment, as in the first embodiment, three ribs 530 are formed to be aligned along the stacking direction. The shape of the rib 530 formed on the most −y direction side is similar to the shape of the rib 530 in the first embodiment. On the other hand, a rib 530A formed at the center in the y direction has a triangular shape as a whole, and has a pointed tip. A rib 530B formed at the position closest to the y direction side has an arcuate tip.

As described above, as the shape of the rib 530, any shape can be adopted as long as the rib 530 can abut on the inner surface 121 of the inlet-side tank 100. All the ribs 530 may have a pointed shape such as 530A, or may have an arc shape such as 530B. However, in order to reliably prevent the inclination of the prevention plate 500, it is preferable to have a shape in which the flat surface 531 is formed at the tip as in the rib 530 of the first embodiment.

The present embodiments have been described above with reference to the specific examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and its arrangement, condition, shape, and the like are not limited to those shown in the examples, and can be changed as appropriate. The combinations of elements included in each of the above described specific examples can be appropriately modified as long as no technical inconsistency occurs.

The invention claimed is:

1. A heat exchanger for heat exchange between air and heat medium, the heat exchanger comprising:

tubes arranged in a stacking direction and being tubular members having flow paths through which the heat medium passes;

a tank that is a container configured to supply the heat medium to each of the tubes, an end portion of the tank in the stacking direction having an opening as an inlet for the heat medium; and a prevention plate having a plate shape and arranged inside the tank, the prevention plate contacting end surfaces of the tubes within a certain region to prevent the heat medium from flowing into the tubes in the certain region, wherein a width direction is defined as a direction perpendicular to the stacking direction and parallel to a direction of air flowing between the tubes, more than one of the flow paths are formed in each of the tubes and arranged in the width direction, the prevention plate has a deformable portion, the deformable portion is elastically deformable by contacting an edge of the opening of the tank at a time of inserting the prevention plate into the tank through the opening, the deformable portion of the prevention plate that has been inserted into the tank is restored and receives a reaction force from an inner surface of the tank such that the prevention plate is shifted along the width direction by the reaction force, the prevention plate includes a rib that prevents the prevention plate from being inclined at a time of the prevention plate being shifted along the width direction inside the tank, the deformable portion includes:

a first deformable portion provided on one side of the prevention plate in the width direction; and a second deformable portion provided on another side of the prevention plate in the width direction, and a length of the first deformable portion and a length of the second deformable portion are different from each other.

2. The heat exchanger according to claim 1, wherein the deformable portion has a rod shape and extends toward the inner surface of the tank.

3. The heat exchanger according to claim 2, wherein the deformable portion is one of deformable portions arranged in the stacking direction.

4. The heat exchanger according to claim 1, wherein-A heat exchanger for heat exchange between air and heat medium, the heat exchanger comprising:

tubes arranged in a stacking direction and being tubular members having flow paths through which the heat medium passes;

a tank that is a container configured to supply the heat medium to each of the tubes, an end portion of the tank in the stacking direction having an opening as an inlet for the heat medium; and a prevention plate having a plate shape and arranged inside the tank, the prevention plate contacting end surfaces of the tubes within a certain region to prevent the heat medium from flowing into the tubes in the certain region, wherein a width direction is defined as a direction perpendicular to the stacking direction and parallel to a direction of air flowing between the tubes, more than one of the flow paths are formed in each of the tubes and arranged in the width direction, the prevention plate has a deformable portion, the deformable portion is elastically deformable by contacting an edge of the opening of the tank at a time of inserting the prevention plate into the tank through the opening, the deformable portion of the prevention plate that has been inserted into the tank is restored and receives a reaction force from an inner surface of the tank such that the prevention plate is shifted along the width direction by the reaction force, the prevention plate includes a rib that prevents the prevention plate from being inclined at a time of the prevention plate being shifted along the width direction inside the tank, and a tip of the rib has a flat surface contacting the inner surface of the tank.

5. The heat exchanger according to claim 4, wherein the rib is one of ribs arranged in the stacking direction.

* * * * *